United States Patent [19]

Kisler

[11] Patent Number: 4,810,522

[45] Date of Patent: Mar. 7, 1989

[54] BATH-FED ELECTROSTATIC COATING APPLICATOR AND METHOD

[75] Inventor: Semyon Kisler, Needham, Mass.

[73] Assignee: Polaroid Corporation, Cambridge, Mass.

[21] Appl. No.: 177,359

[22] Filed: Apr. 4, 1988

[51] Int. Cl.[4] ..... B05D 1/06; B05D 5/02

[52] U.S. Cl. ..... 427/31; 118/624; 118/626; 427/14.1; 427/32

[58] Field of Search ..... 427/14.1, 25, 30, 31, 427/32; 118/624, 626

[56] References Cited

U.S. PATENT DOCUMENTS

| | | | |
|---|---|---|---|
| 2,685,536 | 8/1954 | Starkey et al. | 118/626 X |
| 2,777,784 | 1/1957 | Miller | 118/626 X |
| 2,893,894 | 7/1959 | Ransburg | 427/31 |
| 4,457,256 | 7/1984 | Kisler et al. | 118/621 |

OTHER PUBLICATIONS

U.S. application Ser. No. 32,606, filed Apr. 1, 1987 by Semyon Kisler et al., for Method and Apparatus for Applying Ultra-Thin Coatings to a Substrate.

*Primary Examiner*—Evan Lawrence

*Attorney, Agent, or Firm*—John J. Kelleher

[57] ABSTRACT

A method and apparatus for electrostatically applying a layer of coating material to a moving substrate. In a preferred embodiment, a threaded shaft formed of dielectric material, having one end thereof coupled to a drive motor, has a portion of its threads mounted for rotation through a bath of coating material. An electrostatic field of predetermined magnitude is established between the coating material and a substrate surface spaced therefrom. The electrostatic field atomizes coating material accumulating on the ridge portion of the rotating thread and subsequently deposits a layer of the atomized coating material on the adjacent substrate surface as it is moved past the rotating dielectric thread at a predetermined angle with respect to the axis of rotation of the threaded shaft.

14 Claims, 3 Drawing Sheets

BATH-FED ELECTROSTATIC COATING APPLICATOR AND METHOD

BACKGROUND OF THE INVENTION

The present invention relates to a method and apparatus for applying a layer of coating material to a substrate, in general, and to the application of an extremely thin, constant thickness coating layer or coating layer pattern of such material to the surface of a moving web, in particular.

In many coating applications, extremely thin, constant thickness coatings are absolutely essential in order to avoid degrading the performance of the coated device and/or the equipment with which such coatings are employed. In, for example, audio and video magnetic tapes, if the magnetic media coating is excessively thick or there are significant variations in coating thickness, magnetic coupling and therefore information transferal between the magnetic media in the coating and, for example, the read/write head of audio or video recording or reproducing equipment in which the tape is utilized could be substantially degraded because of the increased spacing or the spacing variations between these components that necessarily result when such coatings are employed.

A number of coating techniques presently exist for applying coating materials to a web or other object's surface. Many of these techniques employ an electrostatic field between a coating applicator and a web or object surface spaced therefrom to assist in both the uniform and efficient deposition of coating material on such a surface. In, for example, the well-known process of electrostatic spray painting, an electrostatic field is established between an electrically conductive grid and a metal object spaced therefrom. The electrostatic field is created by a relatively high DC voltage (100,000 V) connected between grid and object, with the object ordinarily being spaced several feet from the electrified grid. Air pressure supplied to a reservoir of coating fluid coupled to one or more coating applicator orifices causes coating fluid droplet formation at the output of said orifices. The droplets are subsequently propelled into the electrified grid by air pressure generated forces where they become electrostatically charged and then deposited, in layer form, on a metal object surface by forces associated with the electrostatic field. Unfortunately, due to the relatively large droplet size generated by this type of coating apparatus, the resulting coating layer is well in excess of a thickness level that would avoid the above-mentioned problem associated with excessively thick magnetic media coatings.

Electrostatic coating apparatus capable of generating and subsequently depositing relatively small coating material particles on a substrate has been described in copending and commonly assigned U.S. patent application Ser. No. 32,606, by S. KISLER, filed Apr. 1, 1987. In this particular application, a method and apparatus for electrostatically coating articles are disclosed that are capable of applying an extrexely thin and virtually constant thickness coating to a substrate. The method and apparatus include a coating applicator having an opening formed of dielectric material through which coating material flows for substrate coating purposes. The coating material supplied to the applicator is pressurized to maintain a substantially constant volume of coating material at the applicator opening output and is vibrated in the vicinity of the applicator opening to provide a uniform flow of coating material to the applicator output, to stabilize the shape of the coating material at the applicator output and to preclude changes in coating material flow rate caused by electrostatic field induced coating material drying. An electrostatic field of predetermined magnitude is established between the coating material surface and an adjacent substrate to thereby extract minute, uniform sized particles from coating material at the applicator opening and subsequently deposit an extremely thin layer of these particles on the adjacent substrate as it is moved past the applicator opening. While this apparatus is effective in applying a relatively thin layer of coating material to a substrate, the rate at which coating material can be applied with such apparatus is limited and it is relatively difficult to maintain the required volume of coating material at the applicator opening output. In addition, multiple nozzles must be employed when coating very large width webs (e.g. a web having a width of 60 inches). When such a nozzle arrangement is employed, the same pressure must be maintained at the output of each nozzle which is a relatively difficult condition to achieve.

It is a primary cbject of the present invention, therefore, to provide coating apparatus that is capable of applying a constant thickness layer of coating material to a substrate over a wide range of coating material flow rates and over a wide range of coating layer widths.

It is another object of the present invention to provide coating apparatus of reduced complexity that is capable of applying a layer of coating material to a substrate at a constant coating material flow rate.

It is a further object of the present invention to provide coating apparatus that is capable of applying a relatively thin layer of coating material to a substrate in one or more selected coating patterns.

Other objects, features and/or advantages of the present invention will be readily apparent from the following detailed description of a preferred embodiment thereof taken in conjunction with the accompanying drawings.

SUMMARY OF THE INVENTION

In accordance with the present invention, a simplified coating method and apparatus are disclosed that are capable of depositing a constant thickness layer of coating material on a substrate, over a wide range of coating material flow rates and over a wide range of coating layer widths. The method and apparatus include a rotatably mounted shaft member having a plurality of spaced-apart raised portions formed of dielectric material projecting therefrom, in a direction lateral to the axis of shaft member rotation. One end of said shaft member is coupled to a drive motor and said raised shaft portions are mounted for rotation through a bath of coating material. An electrostatic field of predetermined magnitude is established between the coating material and a substrate surface spaced therefrom. The electrostatic field atomizes coating material accumulating on the ridge of each of said rotatable raised shaft portions and subsequently deposits a layer of said atomized coating material on the said adjacent substrate surface as it moves past the rotating shaft member at a predetermined angle with respect to the axis of rotation of said shaft member.

DESCRIPTION OF THE PREFERRED EMBODIMENTS

Figure 1A:
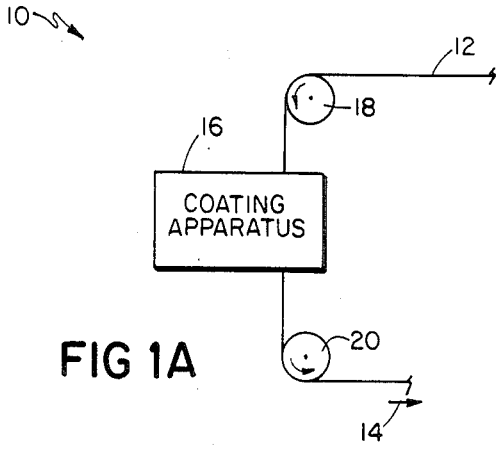
FIG. 1A is a diagrammatic illustration of web coating apparatus employing a preferred embodiment of the coating method and apparatus of the present invention.

In FIG. 1A, numeral 10 generally indicates web coating apparatus employing a preferred embodiment of the web coating method and apparatus of the present invention. As shown in FIG. 1A, polyester web 12 is supported for movement in direction 14 through coating apparatus 16 by support or idler rollers 18 and 20. In this particular coating application, web 12 is a six inch wide, three mil thick sheet of polyester. Drive means (not shown) coupled to web 12 unwinds said web 12 from a sizeable roll thereof (not shown) moves it through said apparatus 16 and then in direction 14 for further processing or, in the alternative, to a conventional rewind station (not shown) for storage prior to incorporation in one or more product assemblies.

Coating apparatus 16 comprises the coating applicator and the coating material to be applied to polyester web 12. As best shown in drawing FIG. 1B, coating apparatus 16 includes electrically conductive stainless steel vessel 22 which is the vessel that contains coating material 24, the material to be applied to a surface of said web 12. The interior of rectangular walled vessel 22 is open to the atmosphere through opening 26 formed in the top thereof. Opening 28 is formed in a side wall of vessel 22 and is coupled to a reservoir of coating material 24 (not shown) remote therefrom, through supply tube 30. Similarly, outlet opening 32 formed in the same sidewall of vessel 22 is coupled to the same coating material reservoir through overflow tube 34.

The height or elevation of surface 36 of coating material 24 within vessel 22 is prevented from rising above a height corresponding to the height or elevation of outlet opening 32 when bottom wall 38 of vessel 22 is horizontally oriented. Pressurized coating material 24 from said coating material reservoir enters vessel 22 through supply tube 30 and inlet opening 28. When surface 36 of coating material 24, rising within vessel 22, reaches outlet cpening 32, it flows back to the coating material reservoir through said opening 22 and overflow tube 34.

Shaft member or feed screw 40, preferably formed of a dielectric material such as polytetrafluorethylene, is mounted for rotation about axis 41 in opening 26 of stainless steel vessel 22. Feed screw 40 is mounted in said opening 26 of vessel 22 such that the lower portion of each of the lateral projections or helical threads 42 of said feed screw 40 are immersed in coating material 24. Energizeable, variable speed motor 44 is mechanically coupled to end 46 of feed screw 40 projecting through wall 48 of the vessel 22. The rotation of feed screw 40 about axis 41 by variable speed motor 44 causes a film of coating material 24 within vessel 22 to accumulate on the helical ridge portions of feed screw threads 42. Feed screw 40 rotational speed and thread pitch are empirically determined and are dependent, in part, upon such factors as coating material viscosity and web speed.

High voltage electrode bar 50, rectangular in cross section, is mounted in a fixed position relative to coating material vessel 22, with its long axis 2 being oriented at right angles to rotational axis 41 of dielectric feed screw 40. Web 12 (FIGS. 1 and 2) is supported for movement between rotatably mounted feed screw 40 and said electrode bar 50. DC power supply 54 having positive and negative power output terminals, has its positive terminal connected to electrode bar 50 through path 56 and has its negative terminal connected to electrically conductive stainless steel vessel 22 through path 58. When DC power supply 54 is energized while variable speed motor 44 is rotating feed screw 40 about axis 41, an electrostatic field is established between coating material 24 accumulating on the helical ridge portion of feed screw threads 42 and said electrode bar 50. Coating material 24 accumulating on the ridge portion of feed screw threads 42 is both atomized by said electrostatic field and sutsequently deposited, in a uniform thickness layer, on surface 60 of web 12 as it is moved, at a constant rate, between feed screw 40 and electrode bar 50.

Figure 1B:
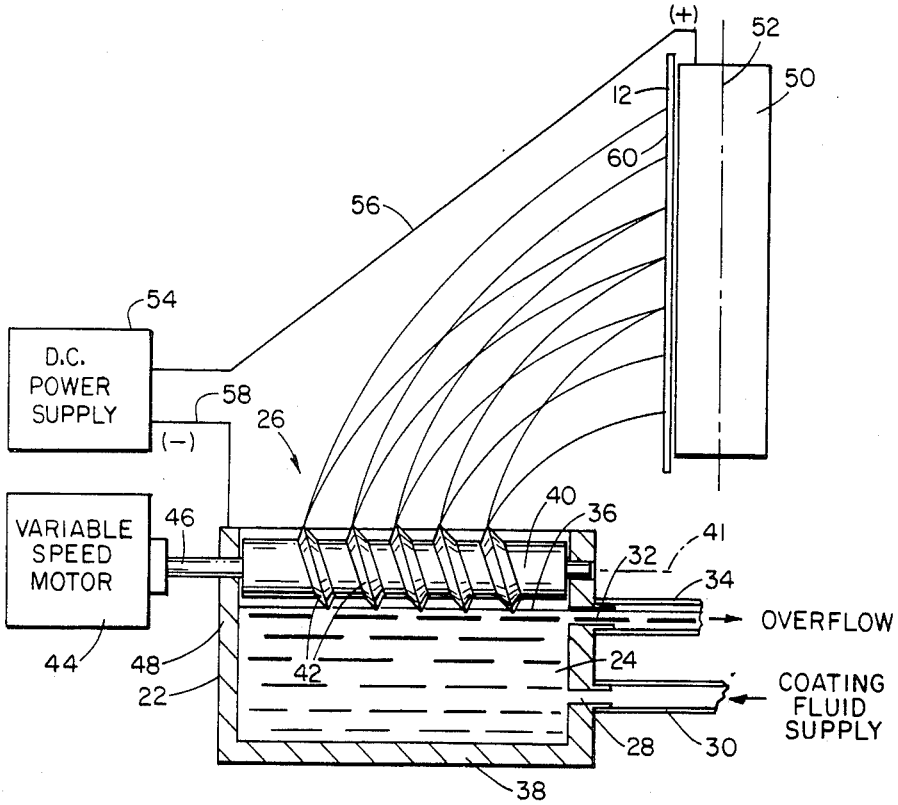
FIG. 1B is a schematic diagram, partly in section, of the coating applicator employed in the web coating apparatus shown in drawing FIG. 1A.

The practical effect of rotating helical threads 42 about axis 41 is that any selected point on the ridge of helical threads 42 moves in the direction of axis 41 as web 12 moves toward a viewer of FIG. 1B, to thereby produce the desired uniform thickness coating. In one particular coating application, the pitch of feed screw threads 42 was two threads per inch, feed screw 40 was rotated at a speed of five revolutions per minute, a voltage (VDC) was established between coating material 24 accumulating at the ridge portion of threads 42 and electrode bar 50, and the web to be coated was moving at a rate of five feet per minute in order to establish a one micron layer of coating material on said moving web. The ridge portions of feed screw threads 42 preferably have the smallest radius of curvature possible so that the required electrostatic field intensity between coating material accumulating on the ridge portions of the rotating feed screw threads 42, conforming to this same small radius of curvature, and electrode bar 50, may be generated at the lowest voltage possible.

Figure 2A:
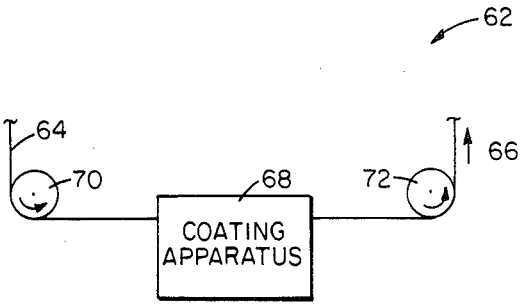
FIG. 2A is a diagrammatic illustration of web coating apparatus employing an alternate embodiment of the coating method and apparatus of the present invention.

In FIG. 2A, numeral 62 generally indicates web coating apparatus employing an alternate embodiment of the web coating method and apparatus of the present invention. As shown in FIG. 2A, polyester web 64 is supported for movement in direction 66 through coating apparatus 68 by rollers 70 and 72. Drive means (not shown) coupled to web 64 unwinds the said wet 64 from a large roll thereof (not shown) moves it through said apparatus 68 and then in direction 66 for further processing, or, in the alternative, to a conventional rewind station (not shown) for storage prior to using same at some later time.

Coating apparatus 68 comprises a coating applicator and the coating material to be applied to polyester web 64. As shown in drawing FIG. 2B, coating apparatus 68 includes electrically conductive stainless steel vessel 74 which is the vessel that contains coating material 76, or the material to be applied to a surface of said web 64. The interior of rectangular walled vessel 74 is open to the atmosphere through opening 78 formed in the top thereof. Opening 80, formed in a sidewall of vessel 74, is coupled to a reservoir of coating material 76 (not shown) remote therefrom through supply tube 82. Similarly, outlet opening 84 formed in a side wall of vessel 74 is coupled to the same coating material reservoir by overflow tube 86.

The height or elevation of surface 88 of coating material 76 within vessel 74 is prevented from rising above a height corresponding to the height of outlet opening 84 when bottom wall 90 of vessel 74 is horizontally oriented. Pressurized coating material 76 from said coating material reservoir enters vessel 74 through supply tube 82 and inlet opening 80. When surface 88 of coating material 76 rising within vessel 74 reaches outlet opening 84, it flows back to the coating material reservoir through said opening 84 and overflow tube 86.

Shaft member or feed screw 92 is mounted for rotation about axis 94 in opening 78 of stainless steel vessel 74. Feed screw 92 is mounted in said opening 78 of vessel 74 such that the lower portion of each of the lateral projections or helical threads 96 of said feed screw 92 are immersed in coating material 76. Energizeable variable speed motor 98 is mechanically coupled to end 100 of feed screw 92 projecting through wall 102 of vessel 74. The rotation of feed screw 92 about axis 94 by variable speed motor 98 causes a film of coating material 76 within vessel 74 to accumulate on the helical ridge portions of feed screw threads 96.

High voltage electrode bar 104, rectangular in cross section, is mounted in a fixed position relative to coating material vessel 74 with its long axis 106 parallel to rotational axis 94 of dielectric feed screw 92. Web 64 is supported fcr movement between rotatably mounted feed screw 92 and said electrode bar 104. DC power supply 108 having positive and negative power output terminals, has its positive terminal connected to electrode bar 104 through path 110 and has its negative terminal connected to electrically conductive stainless steel vessel 74 through path 112. When DC power supply 108 is energized while variable speed motor 98 is rotating feed screw 92 about axis 94, an electrostatic field is established between coating material 76 accumulating on the helical ridge portions of feed screw threads 96 and said electrode bar 104. Coating material 76 accumulating on the ridge portion of feed screw threads 96 is both atomized by said electrostatic field and subsequently deposited, in a selected pattern, on surface 114 of web 64 as it is moved, at a constant rate, between feed screw 92 and electrode bar 104. One such selected pattern is coating layer pattern 115 on web 116 shown in drawing FIG. 2C. The coating layer pattern is primarily determined by the rate of web 64 movement past feed screw 92, the rate at which said feed screw is rotated about its rotational axis 94 and the pitch or lack thereof of feed screw threads 96. For the coating layer pattern shown in drawing FIG. 2C, the speed of web 64 was 5 ft. per minute, the rotational speed of feed screw 92 was 100 revolutions per minute and the pitch of feed screw threads 96 was one-half inch.

Figure 2B:
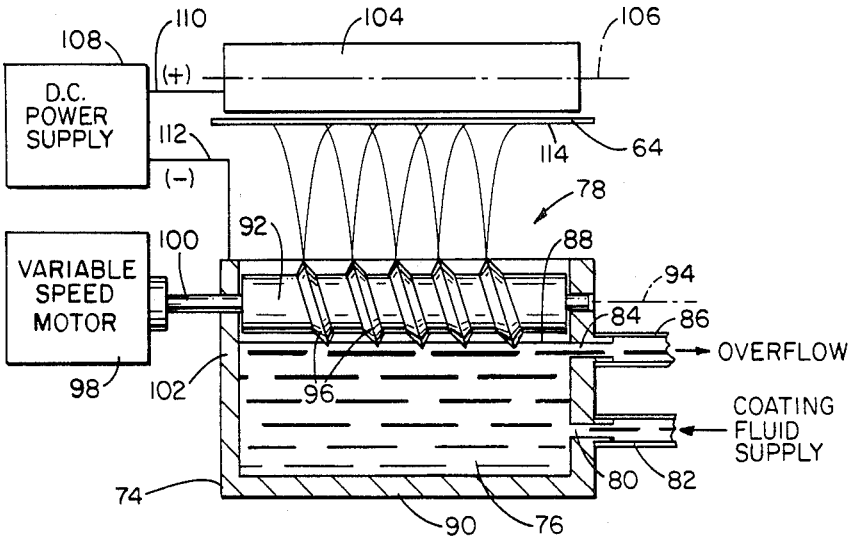
FIG. 2B is a schematic diagram, partly in section, of the coating applicator employed in the web coating apparatus shown in drawing FIG. 2A.
Figure 2C:
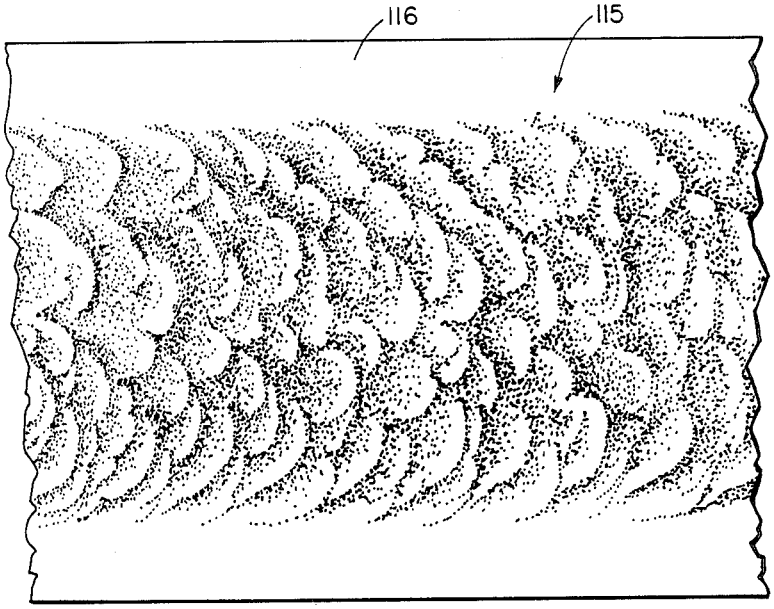
FIG. 2C shows the pattern in which coating material is applied to a moving substrate adjacent thereto by the coating applicator of drawing FIG. 2B.
Figure 2D:
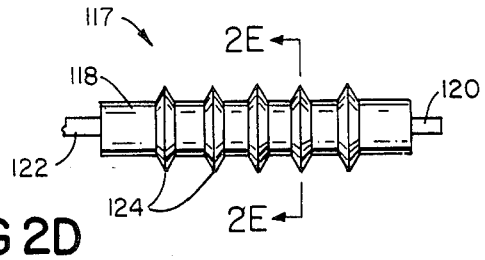
FIG. 2D is an alternate embodiment for the feed member employed in the coating applicator shown in drawing FIG. 2B.
Figure 2E:
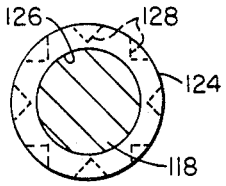
FIG. 2E is a sectional view taken on the line E—E in drawing FIG. 2D.

Feed screw 92 shcwn in drawing FIG. 2B has been described as a helically-threaded shaft member formed of a dielectric material such as polytetrafluorethylene. However, shaft members having shapes different from that shown in drawing FIG. 2B constructed from the same or other dielectric materials, may also be employed. FIG. 2D is an example of one such different shaped shaft member. As shown in FIG. 2D, shaft or feed member 117 comprises cylindrical shank portion 118, formed of either electrically conductive or electrically non-conductive material, having reduced diameter journaled end portions 120 and 122 that make possible the rotation of said feed member 117 in, for example, opening 78 of vessel 74. A plurality of dielectric discs 124 are slidably positioned on shank 118. FIG. 2E is a cross-sectional view of one of said discs 124 taken on the line E—E in drawing FIG. 2D. The diameter of circular opening 126 of all the discs 124 as shown in one example thereof in drawing FIG. 2E is slightly smaller than the diameter of the shank portion of feed member 117. Consequently, these differences in diameter create an interference fit between discs 124 and the cylindrical surface of feed member shank portion 118 to thereby frictionally maintain said discs 124 in a fixed position on feed member 117 when shank portion 118 thereof is inserted through each of the openings 126 in said dielectric discs 124. The outer edges of discs 124 have the smallest radius of curvature possible for the same reasons that such a radius of curvature is employed on the ridge portion of feed screw threads 42 of feed screw 40 described above with respect to drawing FIG. 1B. It should be noted that additional variations in the coating layer pattern applied by coating apparatus 68 (FIG. 2A) may be achieved when discs 124 are employed therein by forming V-shaped notches 128 or other such discontinuities in the outer edge portions of said discs 124. Similar effects can be achieved by forming such discontinuities in, for example, the ridge portions of threads 96 of feed screw 92 shown in drawing FIG. 2B. A pattern formed by a feed member having such V-shaped notches or other such discontinuities would generate a coating layer pattern that would be extremely difficult to repeat absent knowledge of the size of the particular V-shaped notch or shape of other such discontinuities employed on the rotating feed screw. Such a difficult to repeat coating pattern would, for example, be very useful as a security device to prevent the unauthorized reproduction of various ID cards, driver's licenses, bank cards, etc.

It should be noted that while the raised portions of feed screw or feed member 40 (FIG. 1B) and 117 (FIG. 2D) have been respectively described herein as either a helical thread or a plurality of discs, such raised portions could also take the form of brush bristles formed of dielectric material projecting in a similar manner from an elongated shaft member for rotation therewith. Similar discontinuities of the type described above could be incorporated in these brush bristles to produce a unique coating layer pattern by varying the extent to which a bristle or group of bristles project from the axis of rotation of the rotating dielectric bristle brush.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Apparatus for applying a uniform thickness layer of coating material to a substrate, comprising:

a vessel for holding a quantity of said material having an opening therein through which coating material flows for substrate coating purposes;

means for maintaining the surface of coating material held within said vessel at a substantially constant level;

an elongated shaft member having a plurality of spaced-apart raised portions formed of a dielectric material projecting therefrom, in a direction lateral to the direction of shaft member elongation, said shaft member being rotatably mounted adjacent said vessel opening and generally parallel to said coating material surface such that at least a part of said raised shaft member portions will engage and be coated by said coating material upon the rotation of said shaft member;

drive means coupled to said shaft member for rotating said shaft member about its axis of elongation;

means for supporting said substrate in a spaced relation from said elongated shaft member to thereby form a coating gap between said raised shaft member portions and said substrate;

means for establishing an electrostatic field in said coating gap between coating material accumulating on said raised shaft member portions when rotated through coating material held in said vessel by said drive means and a substrate spaced therefrom, to thereby extract coating material particles from said accumulating coating material and subsequently transport said particles to and deposit said particles on said substrate; and means for moving said substrate past said rotatably mounted shaft member, at a constant rate, to thereby deposit a uniform thickness layer of coating material thereon.

2. The apparatus of claim 1 wherein the distal ends of said raised shaft member portions have a minimum radius of curvature.

3. The apparatus of claim 1 wherein said substrate is supported for movement at an angle generally orthogonal to the axis of rotation of said elongated shaft member.

4. The apparatus of claim 1 wherein said substrate is supported for movement in a direction generally parallel to the axis of rotation of said elongated shaft member.

5. The apparatus of claim 1, wherein said means for maintaining the coating material held within said vessel at a substantially constant level comprises:

a source of pressurized coating material;

an inlet tube having one end thereof coupled to the interior of said vessel and with its other end being coupled to said source of coating material; and an outlet tube having one end thereof coupled to the interior of said vessel with its other end being coupled to said source of coating material, whereby the maximum height of coating material entering said vessel at a rate greater than its rate of electrostatic deposition on said substrate is limited to the height of said vessel outlet opening.

6. The apparatus of claim 1, wherein said shaft member drive means is a DC motor.

7. The apparatus of claim 6, wherein said DC motor is of the variable speed type.

8. The apparatus of claim 1, wherein said shaft member is a cylindrical body and said raised shaft member portions are a helical thread formed on the outer surface of said cylindrical body and said shaft member is formed of dielectric material.

9. The apparatus of claim 8, wherein said dielectric material is polytetrafluorethylene.

10. The apparatus of claim 1, wherein said elongated shaft member is a cylindrical body and said raised portions are a plurality of dielectric discs mounted on the cylindrical surface of said body and equally spaced along its axis of elongation.

11. The apparatus of claim 1, wherein said vessel is formed of electrically conductive material and said means for establishing an electrostatic field in said coating gap comprises:

an electrically conductive reference member mounted, in a fixed position, opposite said elongated shaft member with said substrate being supported for movement between said shaft and reference member; and means for applying a voltage between said vessel and said reference member to thereby establish said electrostatic field in said coating gap.

12. The apparatus of claim 11, wherein said vessel is formed of stainless steel.

13. A method for applying a uniform thickness layer of coating material to a substrate, comprising the steps of:

providing a vessel for holding a quantity of said material with an opening therein through which coating material flows for substrate coating purposes;

maintaining the surface of coating material held within said vessel at a substantially constant level;

providing an elongated shaft member having a plurality of spaced-apart raised portions formed of a dielectric material projecting thereform, in a direction lateral to the direction of shaft member elongation, said shaft member being rotatably mounted adjacent said vessel opening and generally parallel to said coating material surface such that at least a part of said raised shaft member portions will engage said coating material upon the rotation of said shaft member;

rotating said shaft member about its axis of elongation with a drive means;

supporting said substrate in a spaced relation from said elongated shaft member to thereby form a coating gap between said raised shaft member portions and said substrate;

establishing an electrostatic field in said coating gap between coating material accumulating on said raised shaft member portions when rotated through coating material held in said vessel by said drive means and a substrate spaced therefrom, to thereby extract coating material particles from said accumulating coating material and subsequently transport said particles to and deposit said particles on said substrate; and moving said substrate past said rotatably mounted shaft member, at a constant rate, to thereby deposit a uniform thickness layer of coating material thereon.

14. The method of claim 13, wherein said vessel is formed of electrically conductive material and said step of establishing an electrostatic field in said coating gap includes:

providing an electrically conductive reference member mounted, in a fixed position, opposite said elongated shaft member and supporting said substrate for movement between said shaft and reference members; and applying a voltage between said vessel and said reference member to thereby establish said electrostatic field in said coating gap.

* * * * *